US012703985B2

(12) United States Patent
Simon et al.

(10) Patent No.: US 12,703,985 B2
(45) Date of Patent: Aug. 11, 2026

(54) DUCT ASSEMBLIES

(71) Applicant: EZ-Duct, Inc., Warren, MI (US)

(72) Inventors: Philip Simon, St. Clair Shores, MI (US); Timothy N. Thomas, Warren, MI (US); Chad Edens, New Baltimore, MI (US)

(73) Assignee: EZ-Duct, Inc., Warren, MI (US)

( * ) Notice: Subject to any disclaimer, the term of this patent is extended or adjusted under 35 U.S.C. 154(b) by 192 days.

(21) Appl. No.: 18/384,147

(22) Filed: Oct. 26, 2023

(65) Prior Publication Data

US 2024/0141657 A1 May 2, 2024

Related U.S. Application Data

(60) Provisional application No. 63/419,676, filed on Oct. 26, 2022.

(51) Int. Cl.
*E04F 19/08* (2006.01)
*E04F 17/08* (2006.01)

(52) U.S. Cl.
CPC ..... *E04F 19/08* (2013.01); *E04F 17/08* (2013.01)

(58) Field of Classification Search
CPC ..... E04F 19/08; E04F 17/08
USPC ..... 52/220
See application file for complete search history.

(56) References Cited

U.S. PATENT DOCUMENTS 3,061,663 A 10/1962 Reiland
3,697,667 A * 10/1972 Pollak ..... H02G 3/0431 174/101
4,166,195 A * 8/1979 Schwab ..... H02G 3/0431 439/211
4,602,124 A * 7/1986 Santucci ..... H01R 25/162 52/287.1
4,907,767 A * 3/1990 Corsi ..... H02G 3/0437 174/101
5,258,572 A * 11/1993 Ozeki ..... H02G 9/10 52/21
5,359,143 A * 10/1994 Simon ..... H02G 3/0608 174/101
5,685,113 A * 11/1997 Reuter ..... E04B 2/7422 52/239
6,061,982 A * 5/2000 Owen ..... H02G 3/285 52/220.1
6,107,575 A * 8/2000 Miranda ..... H02G 3/0437 174/101
6,188,024 B1 * 2/2001 Benito-Navazo .... H02G 3/0418 174/101
6,344,611 B2 * 2/2002 Ewer ..... H02G 3/0608 385/100

(Continued)

*Primary Examiner* — James J Buckle, Jr.
(74) *Attorney, Agent, or Firm* — FisherBroyles, LLP; W. Scott Harders

(57) ABSTRACT

A duct assembly, to house and route utilities for example in floors, walls and overhead spaces, including a plurality of tracks connected together with a plurality of joint bars, where each track includes a bottom side, opposed side walls separated by a central wall and an open top. The assembly includes a shelf support partway along the wall between the bottom side and the open top to support a plurality of middle covers defining a lower chase. The assembly further including a plurality of top covers removably connected to a top of the tracks to define an upper chase.

2 Claims, 2 Drawing Sheets

(56) References Cited

U.S. PATENT DOCUMENTS 6,362,420 B1 * 3/2002 Bacouelle ..... H02G 3/128 174/68.3
6,384,336 B1 * 5/2002 VanderVelde ..... H02G 3/128 174/95
6,459,038 B1 * 10/2002 Waszak ..... H02G 3/0608 174/68.3
6,646,203 B1 * 11/2003 Liao ..... H02G 3/0418 174/95
6,664,467 B1 * 12/2003 de la Borbolla ..... H02G 3/14 174/68.3
6,768,050 B2 * 7/2004 Lockard ..... H02G 3/0608 174/113 C
6,803,519 B2 * 10/2004 de la Borbolla ..... H02G 3/0418 174/95
6,903,265 B1 * 6/2005 VanderVelde ..... H02G 3/0418 174/68.3
6,909,044 B2 * 6/2005 Ewer ..... H02G 3/0608 385/100
6,936,766 B1 * 8/2005 Galasso ..... H02G 3/128 439/211
6,972,367 B2 * 12/2005 Federspiel ..... H02G 3/0437 174/68.3
7,009,108 B2 * 3/2006 Vargas ..... H02G 3/0418 174/53
7,075,005 B1 7/2006 Drane
7,154,052 B2 * 12/2006 Stempinski ..... H02G 3/105 174/68.3
7,193,159 B2 * 3/2007 Makwinski ..... H02G 3/00 174/68.3
7,262,371 B2 * 8/2007 Makwinski ..... H02G 3/0418 174/68.3
7,388,163 B2 * 6/2008 VanderVelde ..... H02G 3/0437 174/68.3
7,654,841 B2 * 2/2010 Arflack ..... H02G 3/105 439/211
7,741,568 B2 * 6/2010 Makwinski ..... H02G 3/0431 174/68.3
7,829,797 B2 * 11/2010 VanderVelde ..... H02G 3/128 174/72 R
8,013,259 B2 * 9/2011 Hill ..... H02G 3/0406 174/95
8,051,614 B1 * 11/2011 Peck ..... H02G 3/22 52/220.8
8,183,460 B2 * 5/2012 Williams ..... H02G 3/0431 174/72 A
8,183,461 B2 * 5/2012 Ewer ..... H02G 3/38 138/116
9,407,077 B2 * 8/2016 De Vis ..... H02G 3/105
9,951,531 B2 * 4/2018 Coon ..... E04F 17/08
10,024,569 B2 * 7/2018 Duffy ..... F16L 57/04
10,443,827 B2 * 10/2019 Lax ..... F21V 33/006
11,005,243 B2 * 5/2021 O'Shaughnessy ... H02G 3/0418
11,223,186 B2 * 1/2022 Li ..... H01R 13/73
11,715,944 B1 * 8/2023 Baldwin ..... H02G 3/0437 174/207
2006/0117684 A1 * 6/2006 Picard ..... H02G 3/00 52/239
2014/0260071 A1 * 9/2014 Coon ..... F16L 9/22 52/741.1

* cited by examiner

DUCT ASSEMBLIES

TECHNICAL FIELD

The invention generally relates to improvements in the field of chases for routing utilities within a facility and methods of assembling and using the same.

BACKGROUND

Several publications are referenced in this application. The cited references are believed to describe the state of the art to which this invention pertains and are hereby incorporated by reference, particularly the systems and methods set forth in the detailed description and figures of each reference.

U.S. Pat. No. 7,075,005 to Drane describes purportedly known systems to run electrical wires and telecommunications wires underneath the surface of a floor. These cables and electrical systems may be placed under the floor surface so as to be more efficient in supplying power and data/telecommunication signals in commercial buildings. The electrical cables or wires beneath the floor may be accessed through a hole in the surface of the floor. In order to provide convenient access to the wires or cables as well as the termination devices which terminate the wires, a floor box is typically placed in the hole through the floor.

U.S. Pat. No. 3,061,663 describes purported improvements in under-floor duct systems for distributing electrical wiring to various locations within a building. Such systems generally comprise a network of junction boxes, ducts, or races for connecting the boxes, and conduit supporting means, all of which are embedded in the concrete floors of the building.

SUMMARY OF INVENTION

The invention relates generally to improved chase ways for utilities such as high and low voltage electric and methods of assembling the same. Specifically described is a duct assembly comprising an open top raceway with removable walkable top covers (when used in a floor based system), unlike known systems that are strictly floor embedded and cased into concrete. The open top allows repositioning of outlets, adding outlets and utilities without tearing up concrete. This is extremely important in today's flexible office spaces.

One aspect of the invention relates to a duct assembly comprising:

A plurality of tracks where each track includes a bottom side, opposed side walls separated by a central wall and an open top, where each wall includes a shelf support partway along the wall between the bottom side and the open top;

A plurality of joint bars received in channels formed in the bottom side of each track, such that a joint bar at least partially is received in channels of adjoining tracks, where the joint bars connect the adjoining tracks together;

A plurality of middle covers in at least some of the tracks supported by the shelf supports, where the middle covers include both solid middle covers and outlet middle covers having an opening sized to permit passage of utilities; and A plurality of top covers including both top solid covers and top outlet covers, the top covers removably connected to a top of the tracks, Where lower chases are defined by the bottom side of the tracks, the side walls, the central wall and the middle covers, and where upper chases are defined by the middle covers, the side walls, the central wall and the top covers.

The foregoing has outlined some of the aspects of the present invention. These aspects should be construed strictly as illustrative of some of the more prominent features and applications of the invention, rather than as limitations on the invention. Many other beneficial results can be obtained by modifying the embodiments within the scope of the invention. Accordingly, for other objects and a full understanding of the invention, refer to the summary of the invention, the detailed description describing the preferred embodiment in addition to the scope of the invention defined by the claims and the accompanying drawings. The unique features characteristic of this invention and operation will be understood more easily with the description and drawings. It is to be understood that the drawings are for illustration and description only and do not define the limits of the invention.

BRIEF DESCRIPTION OF DRAWINGS

The accompanying drawings, which are incorporated in and constitute a part of the specification, illustrate various example systems, methods, and so on that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale. The illustrated embodiments are intended to illustrate, but not to limit the inventions. The drawings contain the following figures.

DETAILED DESCRIPTION

Figure 1:
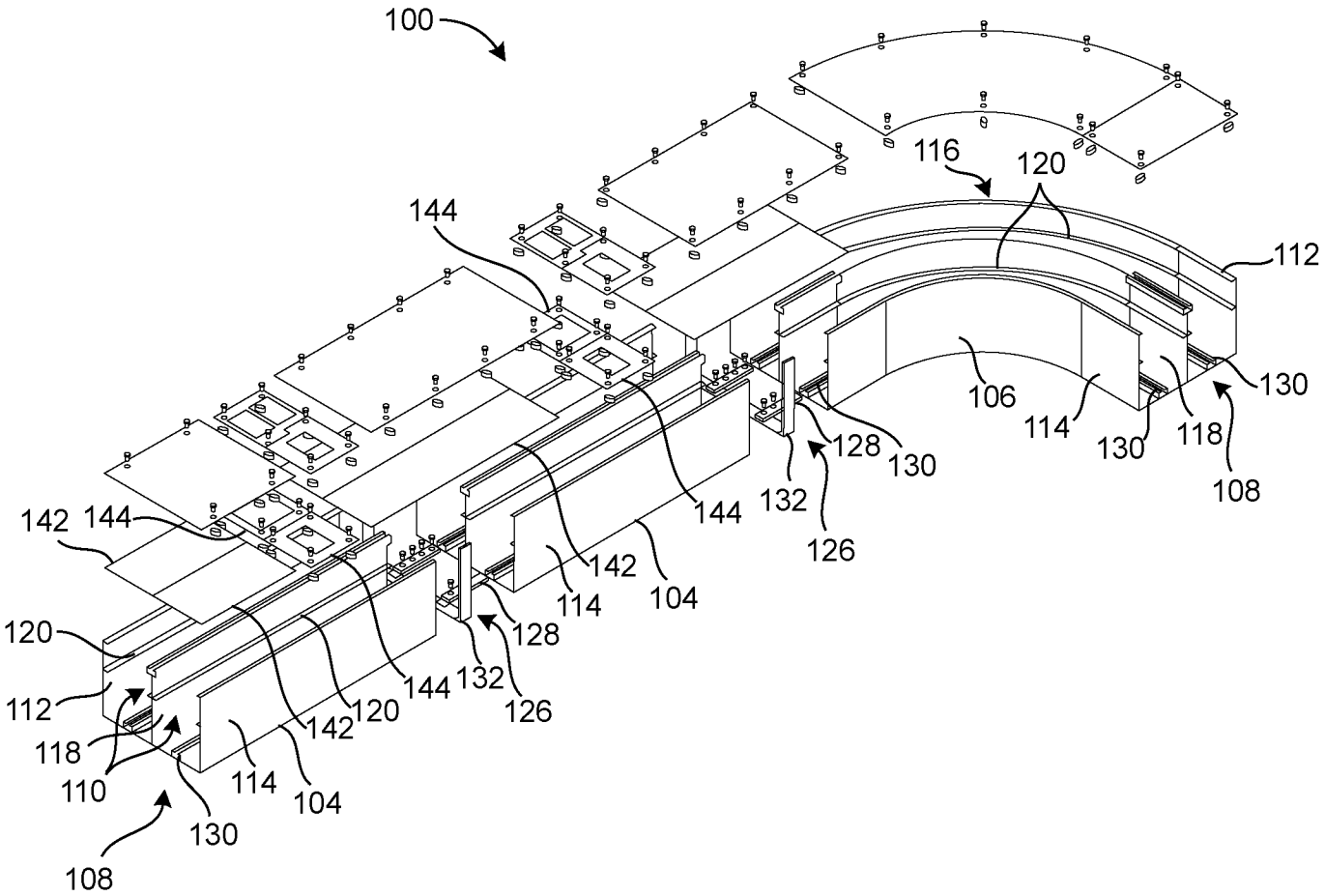
FIG. 1 is an exploded perspective view of select components of an exemplary duct assembly according to an aspect of the disclosure.
Figure 2:
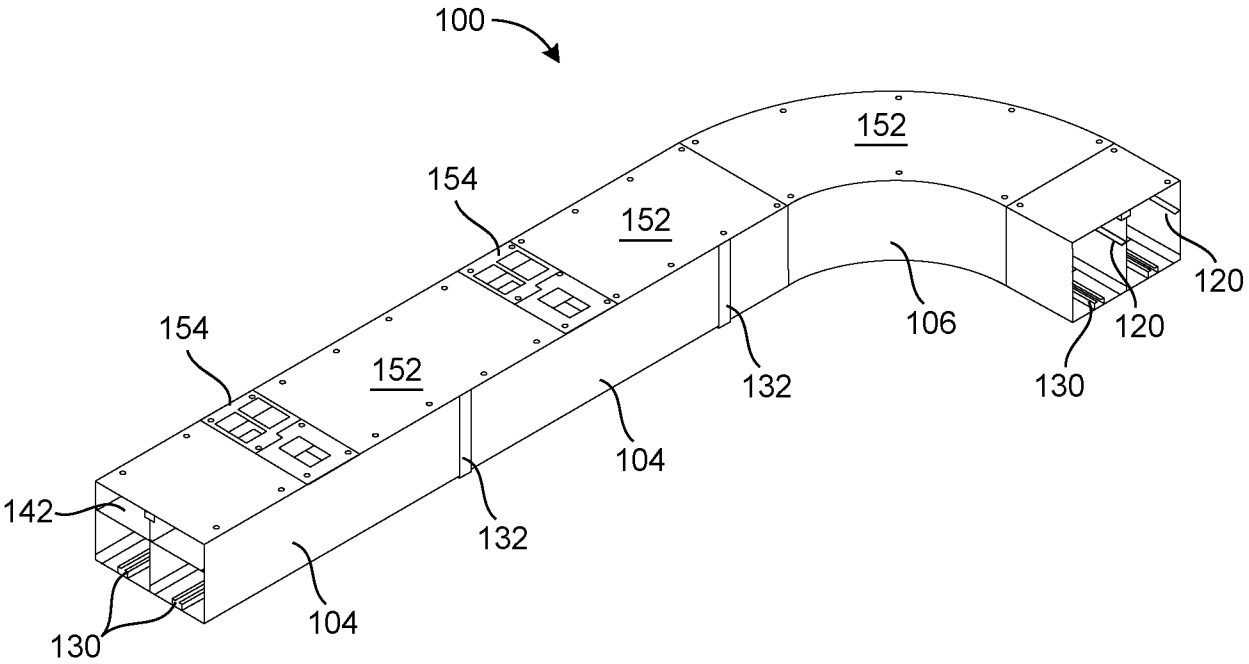
FIG. 2 is a perspective view of an assembled, partial duct assembly of FIG. 1.

In the following description, for purposes of explanation, specific details are set forth in order to provide a thorough understanding of different aspects of the present invention. It will be evident, however, to one skilled in the art that the present invention as defined by the claims may include some or all of the features or embodiments herein described and may further include obvious modifications and equivalents of the features and concepts described herein.

Definitions

As used herein, the singular forms "a", "an" and "the" include plural referents unless the context clearly dictates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect and "about" is utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue. It will be further understood that the endpoints of each of the ranges are significant both in relation to the other endpoint, and independently of the other endpoint. As used in the claims herein, the term "about" in claims refers to a +/−10% variation from the nominal value. It is to be understood that such a variation is always included in any given value provided herein, whether or not it is specifically referred to.

Terms used herein, such as "aspect" or "embodiment" or "exemplary" or "exemplified," are not meant to show preference, but rather to explain that the aspect discussed thereafter is merely one example of the aspect presented.

Additionally, as used herein, relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue. As used in the claims herein, the term "substantially" in claims refers to a +/−10% variation from the nominal value. It is to be understood that such a variation is always included in any given value provided herein, whether or not it is specifically referred to.

The term "connected to" includes connected directly or indirectly and includes portions of items extruded, formed, shaped, stamped, or assembled into a unitary item.

As used herein, the terms "optional" or "optionally" mean that the subsequently described event or circumstance may or may not occur or the component might be omitted, and that the description includes instances where the event or circumstance occurs and instances where it does not or when the component is present or not present.

This system replaces dedicated in-floor systems made with pvc pipe and other types of electrical "chases."

To move outlet locations with a traditional system you have to tear out the floor. The inventive system, we call it the EZ-Duct system, allows for fast and easy electrical updates, remodeling, and repurposing of industrial and office spaces. We believe it is preferable as a two level system. A lower level houses the cables. The device plates mount on the first shelf. The cables are sealed in the lower section with a flexible plastic cover. The space between the upper and lower section allows sufficient bend radius for most cable types. The egress points for the wires are easily moved along the top shelf and the foot traffic covers can be moved and cut to suit. All plates and covers are held secure by metal insert molded pivot nuts.

FIG. 1 shows an exploded perspective view of select components of an exemplary duct assembly 100 according to an aspect of the disclosure. The assembly includes one or more linear tracks, 104, and one or more curved tracks, 106. Preferably, the linear tracks 104 are formed from extruded aluminum to desired lengths. The tracks 104, 106, include a bottom 108 and opposed side walls 112, 114, and an open top 116. Preferably, the tracks 104, 106, include two or more chases 110 defined by side walls 112, 114, and central wall 118. The chases 110 include shelf supports 120 between the bottom 108 and the open top 116. As can be seen, a plurality of tracks 104, 106, can be connected together with joints 126 allowing sectional assembly and placement to form runs of nearly any size and complexity. As illustrated, the joints 126 are formed from a joint bar 128 that is received and connected to complimentary shaped channels 130 formed in the inside bottom 108 of respective tracks 104, 106. A gasket 132 is provided to prevent or retard moisture and debris leakage into the chases 110. In embodiments, when a duct assembly is placed for example in a floor environment, concrete or base material may be installed and desirably a "cover" (not shown) connected to the cover the open top 116 to prevent material from entering the tracks 104, 106. When complete, covers may be removed.

When sufficient tracks 104, 106 have been placed and/or encased, utilities may be placed in respective chases 110. Optionally, after the duct assembly 100, is installed and in use, utilities may be added or removed. Exemplary utilities include high and low power lines that may be desirably run in separate chases. Utilities can also include water lines, data cables, vacuum tubes, compressed air or other gas and pneumatic lines and the like. When utilities are in place, middle covers 142, 144 are placed in the chases and rested upon or snap fit onto shelf supports 120. Middle covers include solid middle covers 142 and outlet middle covers 144 but are not so limited. Outlet middle covers 144 in turn, can be single outlet, dual outlet or provided with other sized openings to allow access to one or more utilities in a lower portion of the chase and bring them into an upper portion at desired locations. Utilities may then be placed through the outlet middle covers roughly where desired. The ability to mount devices on the middle shelf formed by the middle covers 144, provides extra security and protection for sensitive connections like Ethernet or coax outlets. When components are in place, top covers 152, 154 may be installed to cover the open top 116. Top covers include top solid covers 152 and top outlet covers 154 but are not so limited. Top outlet covers 154 in turn, can be single outlet, dual outlet or provided with other sized openings. Significantly, the top covers 152, 154 need not align with the middle covers 142, 144 as the utility may travel in the upper portion of the chase defined by the middle covers to the point where the top covers 152, 154 are placed. Outlets or other utility access points may then be connected to the utility to allow use by a user. Additionally, new utility services may be added at later times. For example, top covers and/or middle covers may be removed to permit access. Also, utilities may be inserted and pulled through.

As may be appreciated, a duct assembly 100 as described, may be located in a floor, wall or overhead partition. Moreover, the duct assembly 100 as described allows easy installation of additional wires or other utilities by traditional pulling or cover(s) removal or combination thereof. As noted, the assembly 100 provides flexibility. For example, egress and device outlet points can be moved to any location. They are not required to be directly above each other.

In the description above, for purposes of explanation only, specific nomenclature is set forth to provide a thorough understanding of the present disclosure. However, it will be apparent to one skilled in the art that these specific details are not required to practice the teachings of the present disclosure.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples.

The description of the scope of the present devices, systems and methods, etc., may include both means plus function and step plus function concepts. However, the claims are not to be interpreted as indicating a "means plus function" relationship unless the word "means" is specifically recited in a claim, and are to be interpreted as indicating a "means plus function" relationship where the word "means" is specifically recited in a claim. Similarly, the claims are not to be interpreted as indicating a "step plus function" relationship unless the word "step" is specifically recited in a claim, and are to be interpreted as indicating a "step plus function" relationship where the word "step" is specifically recited in a claim.

It is understood that the embodiments described herein are for the purpose of elucidation and should not be considered limiting the subject matter of the disclosure. Various modifications, uses, substitutions, combinations, improvements, methods of productions without departing from the scope or spirit of the present invention would be evident to a person skilled in the art.

The invention claimed is:

1. A duct assembly comprising:

A plurality of tracks where each track includes a bottom side, opposed side walls separated by a central wall and an open top, where each wall includes a shelf support partway along the wall between the bottom side and the open top;

A plurality of joint bars received in channels formed in the bottom side of each track, such that a joint bar at least partially is received in channels of adjoining tracks, where the joint bars connect the adjoining tracks together;

A plurality of middle covers in at least some of the tracks supported by the shelf supports, where the middle covers include both solid middle covers and outlet middle covers having an opening sized to permit passage of utilities; and A plurality of top covers including both top solid covers and top outlet covers, the top covers removably connected to the open top of the tracks;

Where lower chases are defined by the bottom side of the tracks, the side walls, the central wall and the middle covers, and where upper chases are defined by the middle covers, the side walls, the central wall and the top covers.

2. The duct assembly as set forth in claim 1, further comprising a gasket surrounding an area where adjoining tracks meet.

* * * * *